US006007037A

United States Patent [19]

Orozco

[11] Patent Number: 6,007,037

[45] Date of Patent: Dec. 28, 1999

[54] MOUNTING SYSTEM FOR STAINED GLASS WINDOW ART

[75] Inventor: Sergio Orozco, West New York, N.J.

[73] Assignee: Quoizel, Inc., Goose Creek, S.C.

[21] Appl. No.: 08/992,529

[22] Filed: Dec. 17, 1997

[51] Int. Cl.[6] ..... A47H 1/10

[52] U.S. Cl. ..... 248/317; 248/322; 40/617

[58] Field of Search ..... 248/317, 322, 248/339, 343, 489, 470, 323, 327, 475.1, 476, 208; 40/757, 617

[56] References Cited

U.S. PATENT DOCUMENTS

| | | | |
|---|---|---|---|
| 340,968 | 4/1886 | Levering | 248/480 |
| 1,095,505 | 5/1914 | Langley | 40/757 |
| 1,095,739 | 5/1914 | Schramm | 40/757 |
| 1,304,479 | 5/1919 | Haws | 248/208 |
| 1,815,185 | 7/1931 | Cobb | 40/617 |
| 1,835,980 | 12/1931 | Hallowell | 40/757 |
| 1,857,314 | 5/1932 | Markman | 248/317 |
| 1,956,303 | 4/1934 | Watson | 40/617 |
| 2,242,804 | 5/1941 | Trowbridge | 40/617 |
| 2,920,857 | 1/1960 | Hagberg | 248/317 |
| 2,954,958 | 10/1960 | Sander et al. | 248/317 |
| 3,782,559 | 1/1974 | Wright | 211/5 |
| 4,061,092 | 12/1977 | Jacobsen et al. | 108/149 |
| 5,090,653 | 2/1992 | Theodorides | 248/317 |
| 5,179,367 | 1/1993 | Shimizu | 340/700 |
| 5,460,274 | 10/1995 | Kramer | 248/322 |

*Primary Examiner*—Derek J. Berger
*Assistant Examiner*—Kimberly Wood
*Attorney, Agent, or Firm*—Gallagher & Kennedy

[57] ABSTRACT

A window art display mounting system for attachment to a frame of a window of a home or other building includes a horizontal mounting member that attaches to the window frame. The horizontal mounting member has secured to it a pair of brackets. A further pair of brackets are connected to a frame for the displayed art. Decorative chains extend between the two pairs of brackets to suspend the frame between the top and the bottom of the window so that the translucent pane of the framed and displayed art work is illuminated by light through the window.

9 Claims, 2 Drawing Sheets

MOUNTING SYSTEM FOR STAINED GLASS WINDOW ART

FIELD OF THE INVENTION

This invention relates to mountings for window art, and more particularly, to a mounting system for hanging art in a window frame to be illuminated by light from the window.

BACKGROUND OF INVENTION

Suspension type mounting systems are used for supporting many types of articles for storage or display. For instance, U.S. Pat. No. 5,460,274, issued to Kramer, discloses a suspension system for storing a bicycle horizontally from a ceiling, while U.S. Pat. No. 3,782,559, issued to Wright, describes a ceiling bicycle rack for storing a bicycle vertically. U.S. Pat. No. 5,179,367, issued to Shimizu, discloses an LCD display suspended so that the viewing angle of the display may be adjusted, and U.S. Pat. No. 2,954,958, issued to Sander et al., discloses stabilized fittings used in hanging a swing seat from a horizontal top bar.

U.S. Pat. No. 2,920,857, issued to Hagberg, discloses a window holding rack to hold a window in a secure vertical position while it is washed. The rack includes a horizontal bracket attached to a horizontal ceiling beam and a pair of hangers mounted to the bracket serving to partially encircle and releasably grip the window frame. A bracket extension attached to the bracket extends in a vertical position along one side of the window frame and holds the frame in place during washing.

While these systems provide for mounting for varying practical purposes, none provides for an attractive mounting and display for window art.

An object of the present invention, then, is to provide a versatile system for attractively mounting window art in a window for illumination. A further object of the present invention is to provide a mounting system for suspending translucent window art from a window frame to receive light passing through a window.

SUMMARY OF THE INVENTION

The present invention provides a versatile and attractive support system for a window art display. The mounting system suspends the art in the frame of a window. A narrow horizontal member is secured along an upper horizontal frame member of the window of a building. The horizontal member has secured to it a first pair of decorative brackets. The displayed art is framed in a display frame to which is affixed a second pair of decorative brackets coordinated with the first pair. Chains or other means or members to suspend the window art display frame extend from the upper horizontal member brackets to the brackets on the display frame. Preferably, the displayed art is a translucent pane such as stained glass and is illuminated by light passing through the window. The shapes of the brackets on the window display frame are such that they can be disposed horizontally, vertically or diagonally, and still satisfactorily cooperate with the chains or other members that suspend the display frame and without appearing to be improperly positioned or disposed. In this way, the mounting system can versatilely and attractively support a wide variety of shapes and sizes of framed window art.

The brackets on the horizontal member and the brackets on the display frame for the art may be of similar shape. Preferably, both pairs of brackets are substantially S-shaped. Suspending chains may have links that are shaped to compliment the two sets of brackets as well. The displayed art and its frame may be square, rectangular, elliptical, circular, arch-like or of another shape without appearing out of place in the support system.

BRIEF DESCRIPTION OF THE DRAWING

Further objects, features and advantages of the invention will become apparent from the following detailed description taken in conjunction with the accompanying figures in which:

FIGS. 2–4 are further front elevation views of the window art mounting system in which the display frames are rectangular, elliptical and arch-like;

Throughout the figures, like numerals designate like features or elements of the illustrated embodiment.

DETAILED DESCRIPTION

Figure 1:
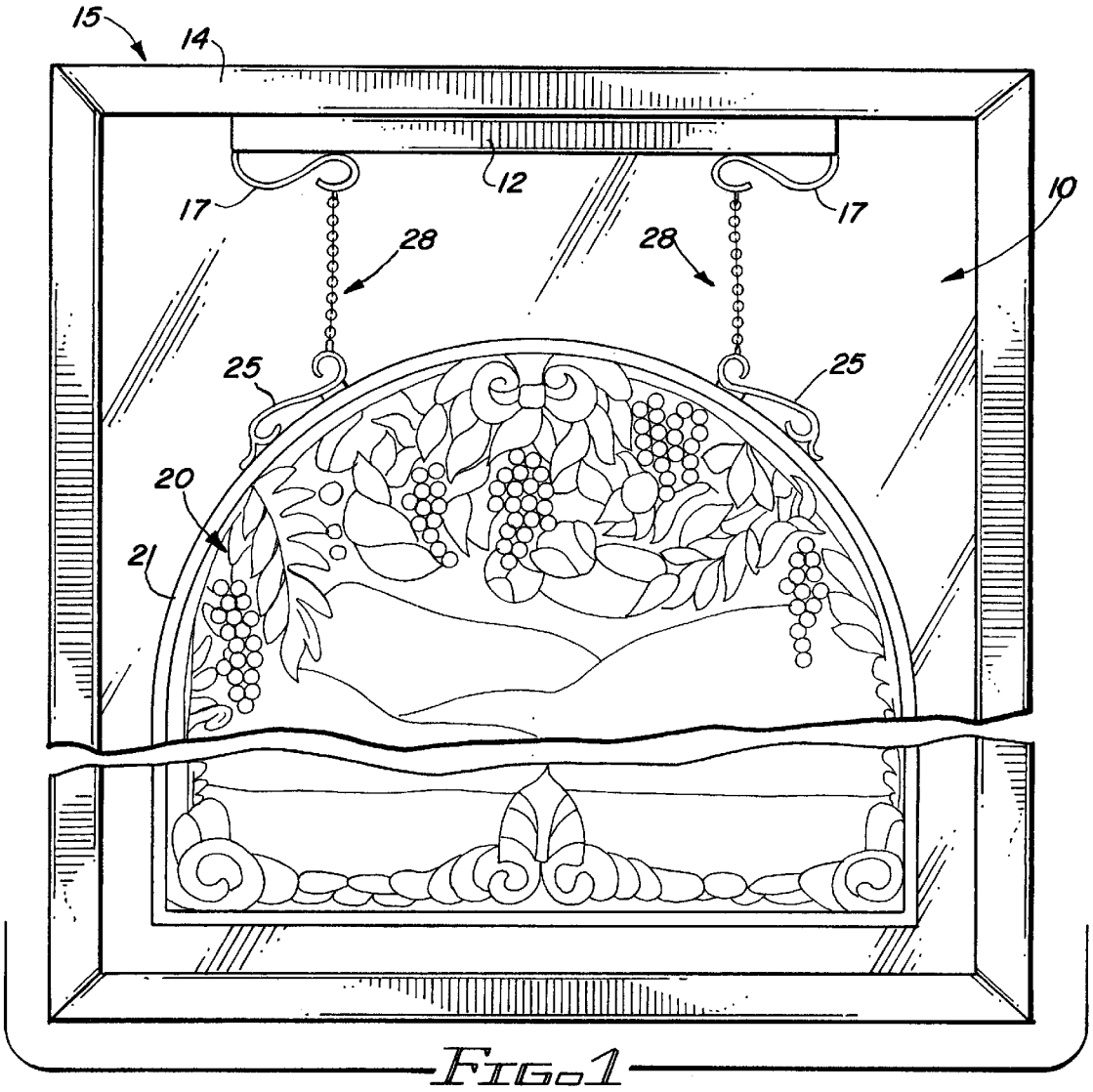
FIG. 1 is a front elevation view of a window art mounting system in accordance with a preferred embodiment of the invention, and shows a display frame suspended in the frame of a window.
Figure 1A:
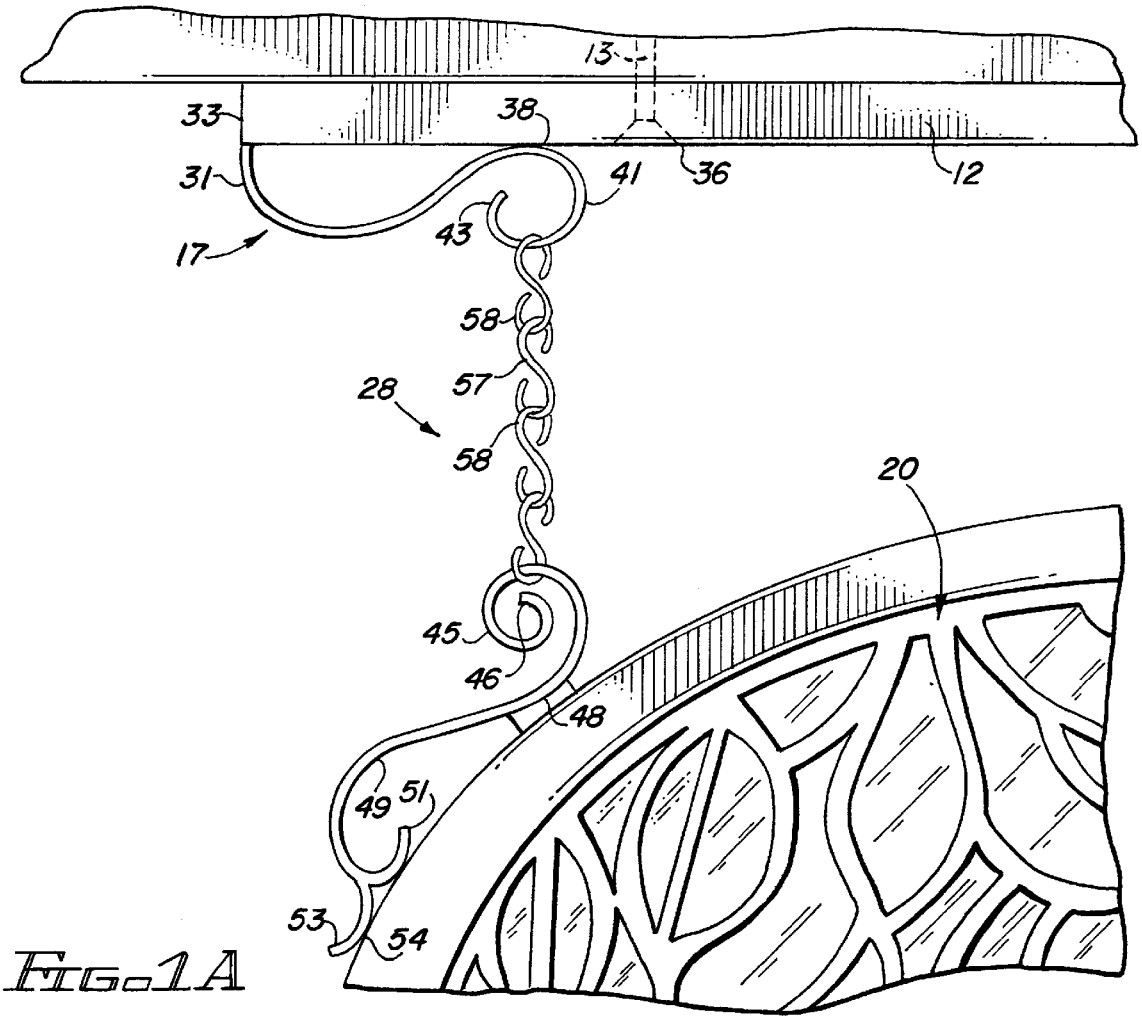
FIG. 1*a* is an enlarged fragmentary front elevation view of the system of FIG. 1, better showing the support provisions for the displayed art.
Figure 3:
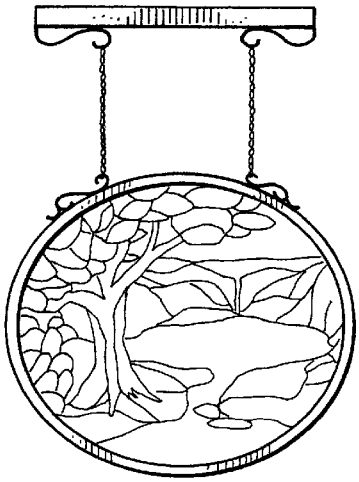

In FIG. 1, window art mounting system 10 includes a horizontal unit or member 12 attached to the under surface of an upper horizontal member 14 of a building's window frame 15. A pair of screws like a screw 13 (FIG. 1A) or other fastening means secures the unit 12 to the frame member 14. A first pair of brackets 17 is affixed to the ends of the horizontal unit 12.

The art to be mounted by the system 10 is preferably a stained glass picture or design pane 20 framed in a frame 21. The frame 21 is called here a "display frame" to distinguish it from the frame 15 of the window in which the art is displayed. The display frame is fitted with a second pair of brackets 25. These are secured to the frame 21 by brazing, spot welding or other means depending on the material chosen for the frame and brackets. The pane forming the displayed work may be one or a large number of pieces of stained glass or other materials.

A pair of chains 28 extend from the upper first brackets 17 to the lower second brackets 25 and suspend the framed art. The two pairs of brackets 17 and 25 and the chains 28 compliment one another. The brackets are of a stylized S-shape both functional and decorative, and the chains include at least one link shaped as a similar stylized S.

Figure 2:
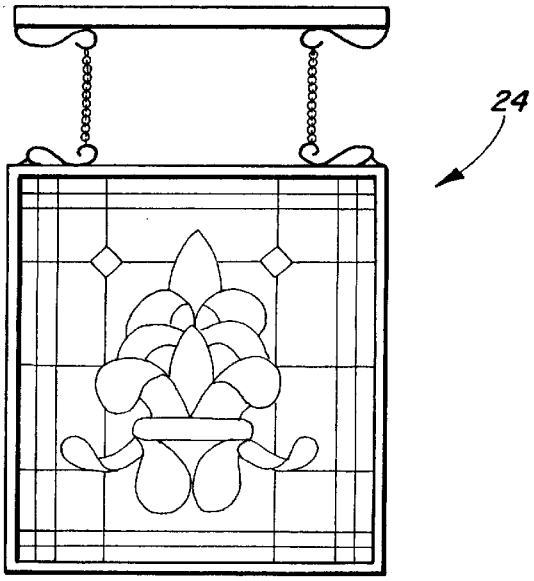

As best seen in FIG. 2, the upper S-shaped bracket is secured to the horizontal unit or member at one end 31 joined to or integral with the end panel 33 of the horizontal unit 12. The bracket curves gracefully inward along an intermediate section 35 reversing curvature and touching the under-surface 36 of the horizontal unit at a point 38. At the tangential meeting of the bracket with the horizontal unit at the point 38, the bracket and horizontal unit can be further connected. Again, this may be brazing or a spot weld, for example, depending on the materials used. From the point 38, the brackets curve again along an approximately circular section 41 away from the horizontal unit to a free end 43.

Each of the lower pair of brackets 25 that is secured to the display frame extends along an upper scrolled curve 45 from a free end 46 to a location 48 tangential to and touching the display frame 21. There it is attached to the frame, again in a manner appropriate to the materials of the brackets and frames. From the point of tangential contact 48, each bracket 25 extends away from the frame 21 in an area 49 and then curves back toward the frame at an end 51. Each bracket 25 connects with a curved end piece 53 attached to the display frame at a location 54.

In each of the pairs of brackets 17 and 25, the free ends 43 and 46 and proximate curved sections 41 and 45 provide effective hooks by which the chains 28 are attached. Each chain 28 includes one or more S-shaped links 57, open at each end. Further S-shaped links 58 are closed at one end and open at the other end. The links of the chains 28, then, compliment the cooperating brackets 17 and 25 and provide ease of attachment to the brackets and easy length adjustment.

Figure 4:
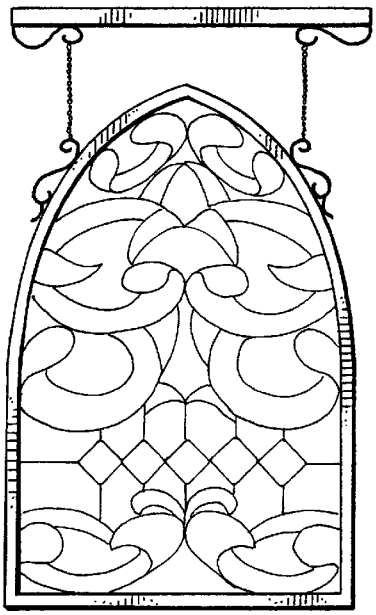

The embodiment of FIG. 1 includes a frame that may be characterized as "curved top rectangular." The embodiments of the invention shown in FIGS. 2 and 4 include display frames 60, 62 and 64 that are rectangular, elliptical and arch-like as examples of the various frame shapes that are functionally and esthetically compatible with the mounting system described and illustrated. In each case, the attached brackets 25 cooperate with frame, locate their hook-forming free ends 46 to readily receive the chain, and without the brackets appearing to be either misplaced or improperly disposed. The mounting system is thus versatile and attractive.

While the subject invention is described above in detail with reference to the preferred embodiments of the drawing figures, it will be understood that changes and modifications can be made to the described embodiments without departing from the spirit and scope of the invention as defined in the appended claims.

I claim:

1. A window art display mounting system for attachment to a frame of a building's window, comprising:

an elongate horizontal member, means for securing the elongate horizontal member directly to an upper horizontal window frame member with an upper, elongate, window frame-engaging surface of the elongate horizontal member in engagement with a surface of the window frame, a first pair of brackets secured to the horizontal member, a window art display comprising a translucent pane, a display frame within which the translucent pane resides, a further pair of brackets secured to the display frame and a pair of frame-suspending members, each of which extends between one of the first and one of the further pairs of brackets, whereby the window art display suspended from the upper horizontal window frame member is suspended proximate to the building's window so that the translucent pane is illuminated by light from the building's window, the first and further pairs of brackets being substantially S-shaped, each of the first pairs of brackets being affixed to the horizontal member with an end of the substantially S-shaped bracket secured to an end of the horizontal member and each of the first pairs of bracket curving inward towards the middle of the horizontal member thence upward to the undersurface thereof and reversing curvature away from the undersurface to from a returning curve defining a hook for attachment to the suspending members.

2. The window art display mounting system of claim 1 wherein the suspending members comprise a pair of chains.

3. The window art display mounting system of claim 1 wherein the first and further pair of brackets are formed in complimentary shapes.

4. The window art display mounting system of claim 1 wherein each of the brackets secured to the display frame curve from a curved free end defining a hook for attachment of the suspending members to a location tangential to the display frame where the bracket is secured to the frame, and each of the brackets secured to the frame extends away from the tangential location and away from the display frame to a curved end piece also secured to the display frame.

5. The window art display mounting system of claim 1 wherein the pane is of stained glass.

6. The window art display mounting system of claim 2 wherein each chain includes at least one link of a shape complimentary to the first brackets and further pairs of brackets.

7. The window art display mounting system of claim 2 wherein each chain has at least one S-shaped link.

8. The window art display mounting system of claim 1 wherein the display frame is selected from the group consisting of elliptical, circular, square, rectangular, curved top rectangular or arch-like form.

9. A window art display mounting system mounting framed glass art in close, light communicating proximity to a window, the display mounting comprising:

(a) an elongate horizontal mounting member including:

(i) an upper, elongate window framing-engaging surface, (ii) means for securing the horizontal member to the window framing above a window with the upper, elongate, window-framing-engaging surface in direct contact with window framing, (iii) a front panel portion of the elongate horizontal mounting member masking the means for securing from view, (b) a first pair of spaced-apart brackets secured to the elongate horizontal mounting member with reversely turning, open, scrolled chain link receiving hook portions, the first pair of spaced-apart brackets being proximate ends of the horizontal mounting member, (c) an art glass frame, (d) translucent art glass mounted within the frame, (e) a second pair of spaced-apart brackets secured to the frame, each including reversely turning, open, scrolled chain link receiving hook portions, and (f) a pair of suspending chains extending from the reversely turning, open, scrolled, chain link receiving hooks of the first pair of spaced apart brackets secured to the elongate member to the reversely turning, open, scrolled, chain link receiving hooks of the second pair of spaced-apart brackets secured to the frame, each of the brackets secured to the art glass frame curving from a curved free end defining a hook for attachment of the suspending chains to a location tangential to the art glass frame where the bracket is secured to the art glass frame, and each of the brackets secured to the art glass frame extends away from the tangential location and away from the art glass frame to a curved end piece also secured to the art glass frame.

* * * * *

UNITED STATES PATENT AND TRADEMARK OFFICE

CERTIFICATE OF CORRECTION

PATENT NO. : 6,007,037

DATED : December 28, 1999

INVENTOR(S) : Sergio Orozco

It is certified that error appears in the above-identified patent and that said Letters Patent is hereby corrected as shown below:

Column 3, line 55, after "first" change "pairs" to --pair--.

Column 3, line 58, after "first" change "pairs" to --pair--.

Column 3, line 61, after "to" change "from" to --form--.

Column 4, line 12, after "1" insert --,--.

Column 4, line 14, after "2" insert --,--.

Column 4, line 18, after "2" insert --,--.

Column 4, line 20, after "1" insert --,--.

Signed and Sealed this

Thirteenth Day of June, 2000

*Attest:*

Q. TODD DICKINSON

*Attesting Officer*

*Director of Patents and Trademarks*